US005222736A

United States Patent [19]

Workman et al.

[11] Patent Number: 5,222,736

[45] Date of Patent: Jun. 29, 1993

[54] MULTIGAME GAME BOARD

[75] Inventors: Tom E. Workman, 4000 Rock Creek Dr., Dallas, Tex. 75204; Sidney V. Bryan, Fort Worth, Tex.

[73] Assignee: Tom E. Workman, Dallas, Tex.

[21] Appl. No.: 790,420

[22] Filed: Nov. 6, 1991

Related U.S. Application Data

[63] Continuation-in-part of Ser. No. 330,868, Mar. 29, 1989.

[51] Int. Cl.[5] ..... A63F 7/36

[52] U.S. Cl. ..... 273/123 R; 273/118 R

[58] Field of Search ..... 273/108, 118 R, 118 A, 273/118 D, 123 R, 123 A, 138 R, 138 A, 142 R, 142 E, 142 F, 142 H, 142 HA

[56] References Cited

U.S. PATENT DOCUMENTS

| | | | |
|---|---|---|---|
| 434,721 | 8/1890 | Peters . | |
| 1,340,304 | 5/1920 | Taussig et al. . | |
| 1,427,135 | 8/1922 | Tenney . | |
| 1,468,984 | 9/1923 | Weaver . | |
| 1,520,697 | 12/1924 | Carlson | 273/142 F |
| 1,560,496 | 11/1925 | Bakketun . | |
| 1,824,647 | 9/1931 | Wright | 273/142 F |
| 2,087,555 | 7/1937 | Simpson | 273/142 F |
| 2,361,471 | 10/1944 | Fontaine, Jr. | 273/123 R |
| 2,492,462 | 12/1949 | Ceasar | 273/123 R |
| 2,811,362 | 10/1957 | Bareither | 273/142 E |
| 3,989,252 | 11/1976 | Mattson . | |
| 4,474,374 | 10/1984 | Lewis et al. | 273/123 R |

FOREIGN PATENT DOCUMENTS 305747 5/1955 Switzerland .

*Primary Examiner*—William H. Grieb
*Assistant Examiner*—Raleigh W. Chiu
*Attorney, Agent, or Firm*—Warren B. Kice; Jeffrey M. Becker

[57] ABSTRACT

A game board supplied with removable indicia for altering the configuration of the game board to facilitate the playing of multiple games. A sloped surface for rolling a ball is disposed between an outer annulus having a top face and a circular disk concentric therewith having a top face and a scalloped vertical wall for receiving the ball, wherein the top faces of the annulus and the disk receive the removable indicia.

13 Claims, 2 Drawing Sheets

MULTIGAME GAME BOARD

CROSS-REFERENCE TO RELATED APPLICATIONS

This application is a continuation-in-part of U.S. Design patent application Ser. No. 07/330,868, filed Mar. 29, 1989.

FIELD OF THE INVENTION

The invention relates generally to recreational and amusement games of skill and chance, and particularly to a circular pocketed game board for receiving balls.

DESCRIPTION OF THE PRIOR ART

The game of roulette is initiated by the dealer spinning the wheel in a counterclockwise direction, and then tossing or rolling a ball on an outer annular track in the opposite direction to the wheel. When the ball slows down and drops off the outer track, it is prevented from coming to rest on the inner wheel by the centrifugal force generated by the rotation of the wheel. Only after the inner wheel's rotation is sufficiently reduced may the ball finally be allowed to come to rest upon the wheel. When the ball falls and comes to rest between any two metal partitions of the wheel, it marks the winning number and color.

The prior art discloses several variations on the standard roulette wheel that involve varying levels of skill and chance.

Taussig et al., U.S. Pat. No. 1,340,304, disclose a game board having a plurality of pockets disposed in the surface of a rotary member. Movement is imparted to a ball by spinning or rotating the member. In the play of the game, each player takes turns in spinning the member. As the ball comes to rest in a pocket, each player notes the number opposite the pocket in which the ball came to rest. After each player has spun the member five times, the player with the highest total score is deemed the winner.

Tenney, U.S. Pat. No. 1,427,135, discloses a game board having a sloping annular surface inclined toward the outside of the board where a plurality of holes are provided. Balls are projected outward toward the annular surface due to centrifugal force generated by an inner rotating disk. The score is obtained by summing the value associated with the holes in which the balls have come to rest.

Peters, U.S. Pat. No. 434,721, discloses a circular game board having an outer annular track. The track is inclined toward its center where there are numbered grooves. Twelve balls are thrown or rolled around the track and balls landing in any of the grooves are scored by totalling the numbers associated with the grooves.

The foregoing prior art has several distinct disadvantages. In general, none of the prior art devices permit multiple game use, and specifically, none of the foregoing game boards permit the playing of more than a single class of games, such as, cards. Thus, the utility of the game is limited and consumers are prone to become bored. Also, most of the game boards disclosed in the prior art utilize rotating wheels that are prone to wear and breakage. In addition, none of the prior art devices provide pockets for the storage of game pieces. Consequently, balls required for play often become lost rendering the game useless. Further, none of the prior art devices serve any function when not being used for game playing and become encumbrances to their owners.

SUMMARY OF THE INVENTION

It is therefore an object of the present invention to provide a game board that facilitates the playing of a large number of games via game board reconfiguration parts.

It is a further objective of the present invention to provide a game board of the above type with increased reliability through the elimination of redundant and superfluous moving parts.

It is still a further object of the present invention to provide a game board of the above type which contains pockets for the storage of game pieces.

It is still a further objective of the present invention to provide a game board of the above type with a removable top to provide additional games and utility.

Toward the fulfillment of these and other objects, the game board of the present invention relates to a nonrotating circular game board that is defined by two raised concentric surfaces and a sloped annular track disposed therebetween. The game board is designed for use with or without removable graphic pieces or game board reconfiguration parts. The game board reconfiguration parts are supplied with printed indicia to facilitate the playing of multiple games. Pockets are formed in the game board for the storage of game pieces when not in use. The game board can be supplied with legs and a removable top with printed indicia of various game board graphics for added utility. Also, the removable top functions or doubles as a table top in the event the game board is not being used for the playing of games.

BRIEF DESCRIPTION OF THE DRAWINGS

The above description, as well as further objects, features, and advantages of the present invention, will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENTS

Figure 1:
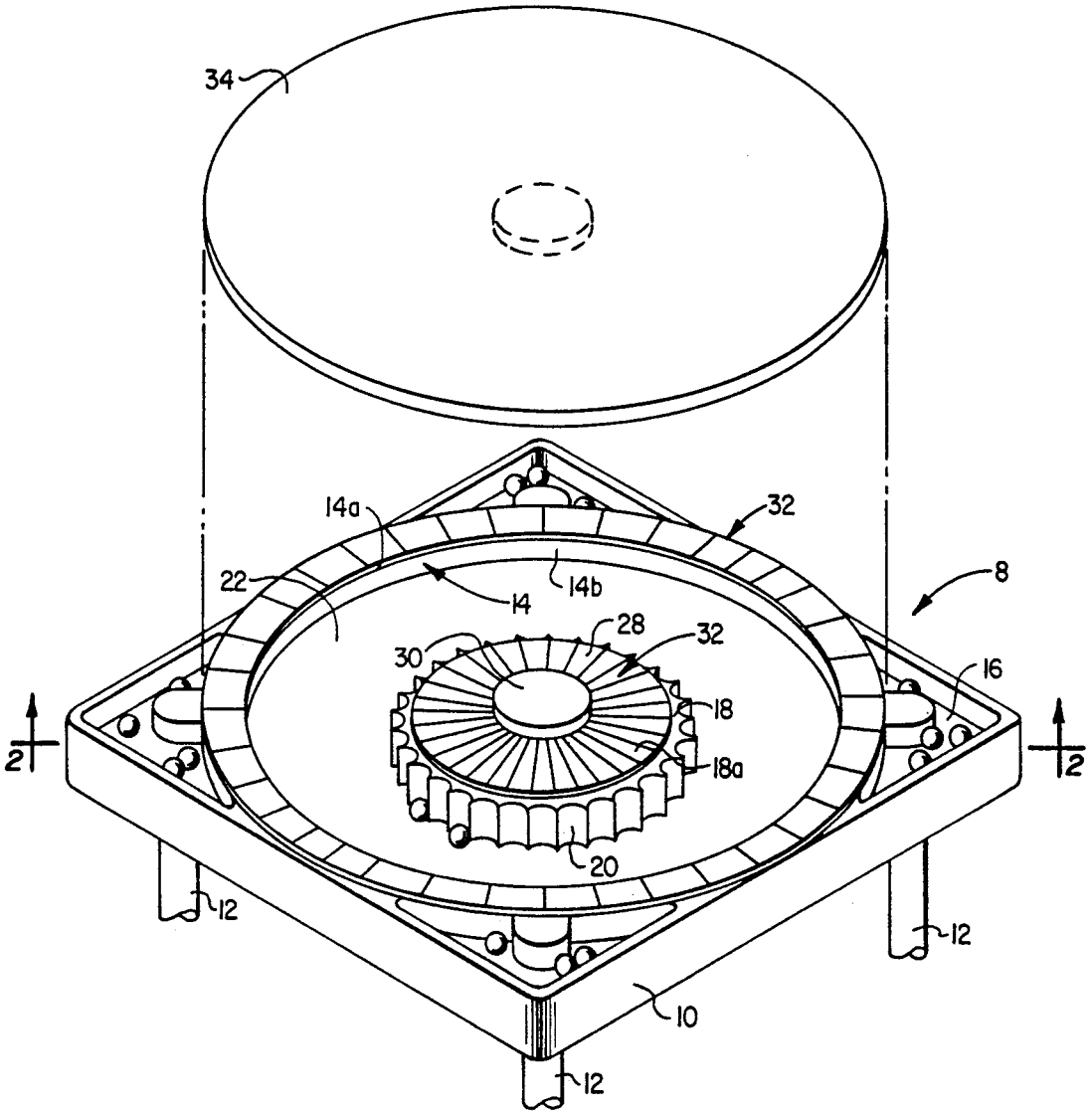
FIG. 1 is a perspective view of the present invention.

FIG. 1 of the drawings depicts the game board 8 of the present invention which is utilized in the playing of numerous games. The game board 8 includes a square perimeter 10 that is supported by legs 12 in a manner to be described later. Disposed within the perimeter 10 is a raised annular track 14 having a top surface 14*a* and a downwardly extending wall 14*b*. The top surface 14*a* may be used for the placement of chips or game pieces and the like. Storage pockets 16 are disposed in the recesses formed in the corners of the perimeter 10 between the perimeter 10 and the track 14 to accommodate the storage of game pieces, balls, chips and the like when not in use. Concentric to the track 14 is a raised center section 18 having a top surface 18*a* surrounding a concentric circular recess 19. The outer wall of the center section 18 has a series of semicircular curved indentations or scallops 20 that form a functional border for the catching of balls. Between the track 14 and the center section 18 is a sloped surface 22 that slopes from the lower end of the wall 14b toward the bottom of the center section 18 and is for the throwing or rolling of balls.

Figure 2:
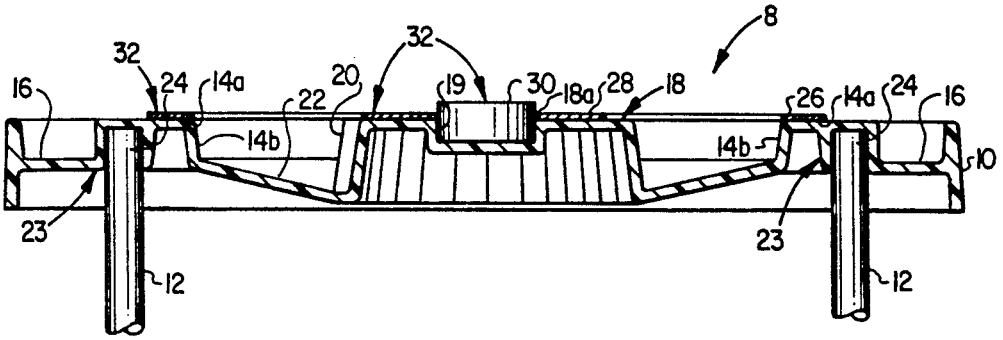
FIG. 2 is a cross-sectional view taken along line 2—2 of FIG. 1.

Referring to FIG. 2, there is shown a leg retaining structure 23 for securing the legs 12 to the board 8. The leg retaining structure 23 comprises a well 24 for receiving one of the legs 12. Each leg is secured in its respective well 24 by being press fit or glued. The legs may extend vertically, as shown, or diagonally in a tripod fashion. While not shown, it is understood that the leg retaining structure 23 may also comprise a collar or clamp, as well as, a leg liner and insert to aid in securing the legs 12 to the game board 8. Each leg well 24 may have additional structural support provided by a gusset, also not shown.

An outer graphics ring 26 rests on the top surface 14a of the track 14 and has printed indicia for the placement of chips, game pieces and the like. While not shown in the drawings, it is to be appreciated that the ring 26 may be retained by providing the perimeter 10 with raised edges or by conventional methods such as pin/hole arrangements. Similarly, an inner graphics ring 28 rests on the top surface 18a of the center section 18 and has printed indicia that may be used in determining the score, the outcome of a turn or for the placement of a wager. Concentric with the inner graphics ring 28 is a central hub 30 which resides in the recess 19. The central hub 30 is supplied with printed indicia and serves as a retainer for the inner graphics ring 28.

In other preferred embodiments, the inner graphics ring 28 may be retained by a raised hub that is concentric to and part of the center section 18 o by conventional methods. While not shown, it is to be appreciated that the rings 26, 28 and the hub 30, referred to collectively as the game board reconfiguration parts 32, are to be printed on both sides with game board graphics and may be used to change the type of games that may be played on the game board 8.

Figure 3:
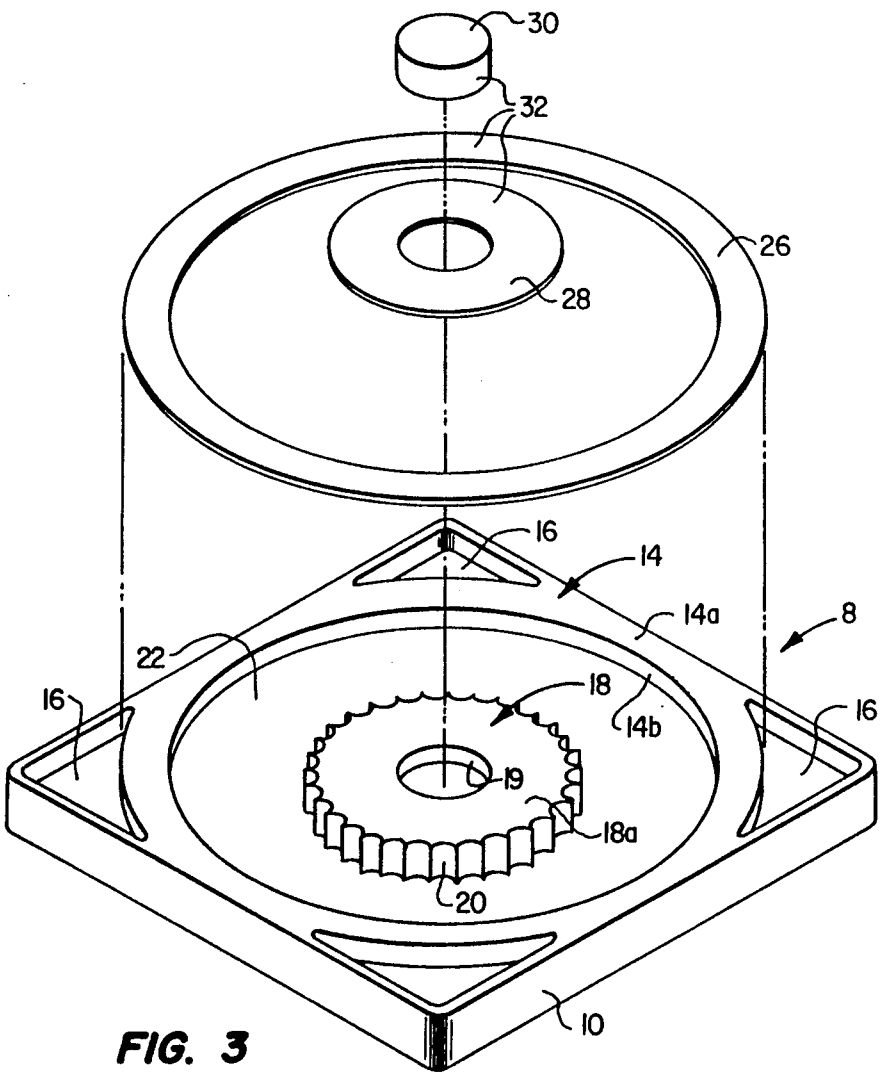
FIG. 3 is an exploded view of an alternative embodiment of the present invention.

Referring to FIG. 3, there is shown an exploded view of an alternate preferred embodiment of the present invention lacking any legs 12 or wells 24 but illustrating the game board reconfiguration parts 32 that can be used with each embodiment for game board reconfiguration. While not shown in the drawings, it is to be understood that the game board of FIG. 3 is to be supplied with a slide fit bottom or base. The base is defined by a square planar surface with four walls extending extensively in a perpendicular and vertical fashion from the planar surface. The walls are intended to conform with the perimeter 10 of the game board 8 so as to create a friction fit within the perimeter 10. The base can be constructed from any appropriate material, preferably from cut and folded corrugated cardboard or from plastic. Bases constructed out of plastic can be supplied with grommets or feet for the purpose of keeping the game board 8 from sliding.

Figure 4:
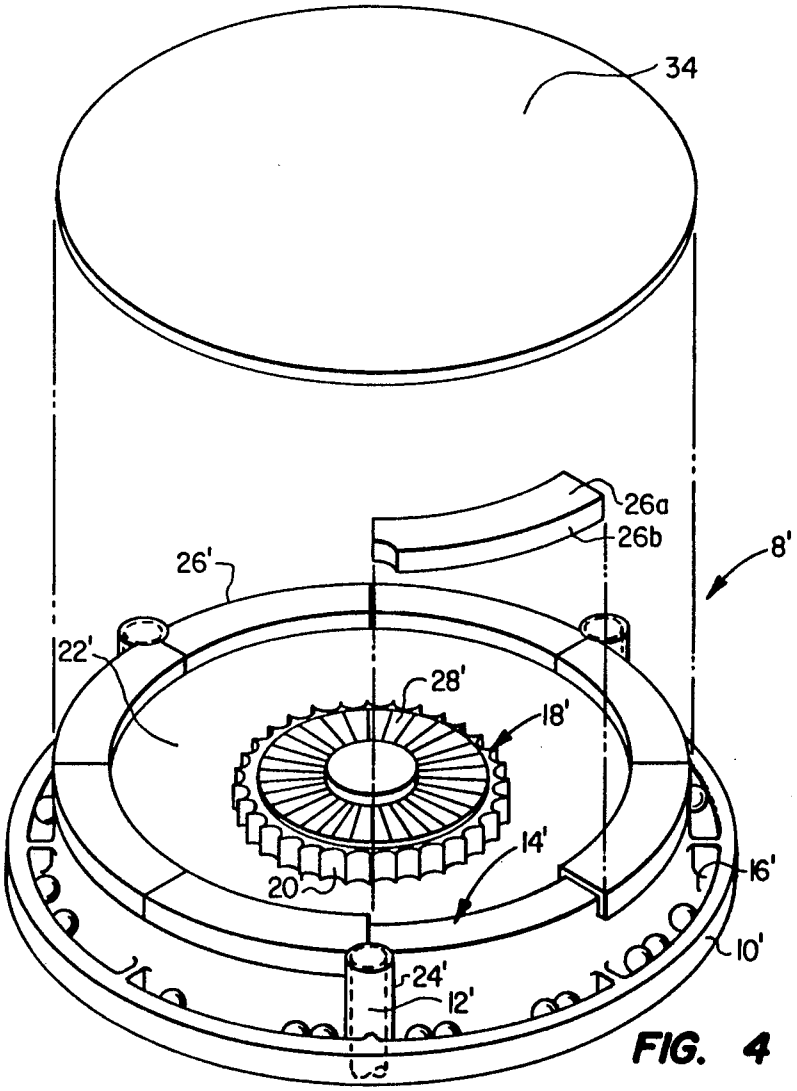
FIG. 4 is an exploded view of another alternate embodiment of the present invention.

Referring to FIG. 4 there is illustrated another alternate preferred embodiment of the present invention in which like elements to the previous embodiments are referred to with primed reference numerals. Features such as the center section 18' and the surface 22' do not vary from the other alternatives previously described. This embodiment does vary, however, in that it is defined by a round perimeter 10', an annular track 14' raised above the perimeter 10' and a plurality of storage pockets 16' for the storage of game pieces, balls, chips, and the like disposed therebetween. Also disposed between the perimeter 10' and the track 14' are a plurality of leg wells 24' for receiving legs 12' as previously described. The outer graphics ring 26' is divided into a plurality of semicircular sections 26a which provides for easy storage of the outer graphics ring 26'. The sections 26a are provided with lips 26b that fit over the track 14' for securing the sections 26a to the track 14'.

Shown in FIGS. 1 and 4 is a removable top 34 that may be used with any preferred embodiment of the present invention. The top 34 is supplied with printed indicia on both sides with various traditional game board graphics, such as, chess, checkers, backgammon, and the like, as well as new and innovated nontraditional games, and may serve as a table top. The top 34 may be retained by providing the perimeter 10' with raised edges.

In operation, a large number of games may be played with the game board 8. For example and referring to the embodiment of FIG. 1, there is the game of Spiroulette TM that is similar to but different from the traditional game of roulette. In the play of the game, bets are placed on a wagering mat which may be incorporated on the inner graphics ring 28 or be separate from the game board. After the placing of bets, a ball is thrown or rolled around the sloped surface 22 in a clockwise direction. Each roll must complete at least one full rotation around the sloped surface 22 to be a valid roll. When the ball slows down, falls and comes to rest within a scallop 20, it marks the winning number and the winning color o the inner graphics ring 28. The winner or winners are then paid off with the correct amount of chips due to each winning bet. The game mat also can be used to change the type of game to be played by the printed graphic indicia.

Another basic game is Spiralette TM and does not require the use of the inner graphics ring 28. In the play of the game, each player has a set of colored balls all of the same color. Each player takes a turn in a clockwise direction around the game board 8. Balls are to be rolled in a clockwise direction around the surface 22. Each roll must complete at least a one-half rotation around the surface 22 to be counted as part of its player's score. As long as the rolls are made in the proper clockwise sequence of turns, a player can roll at any time, even if the previous roll is still in motion.

In Spiralette TM, scores are based on the relative position of the balls to one another. Each player's game is completed when he has rolled all of his balls, and the total score for his rolls is that player's game score. The highest score is the winning score, and in the case of a tie, an extra roll is made until the tie is broken.

An additional game is Spirabilliards TM, a game that is similar to the traditional game of billiards or pool but can only be played with the present invention.

While not disclosed here, it is to be appreciated that through the use of the game board reconfiguration parts 25 and game mats, far more games may be played than can be explicitly delineated here. However, for the sake of completeness, a partial list of typical games that may be played is set forth. Games that are to be played with one or more of the game board reconfiguration parts 32 include:

games of risk, such as, horse racing, get rich, gold digger, poker and other card games;

games of sport, such as, baseball and football; and games of war, such as, risk and conquer.

Other classes of games that may be played include, but are not limited to, games of thought, education, mystery and physical skill.

The apparatus and method of the present invention has several advantages over the prior art. For example, through the use of the game board reconfiguration parts 32, the game board may be arranged into multiple games. Further, the game board has no moving parts, such as an inner rotating wheel to wear out or break down. While this increases reliability, it also adds the elements of skill and strategy to the play of the game and decreases the significance of luck. Also, the game board has pockets 16 for the storage of balls, chips, game pieces and the like. In addition, the game board may be supplied with a removal top 34 for additional utility. The top 34 allows the game board to be used as a table when it is being used for playing games. In addition, the top 34 has printed indicia with various traditional and innovated nontraditional board graphics providing added value.

It is understood that several variations may be made in the foregoing without departing from the scope of the invention. For example, the game board may be supplied with or without legs. Also, the perimeter 10, the track 14, the center section 18, the surface 22, the game board reconfiguration parts 32 and the top 34 may have alternate geometric shapes, such as, oblong, elliptical, polygonal, and other shapes. Similarly, the slope of the surface 22 need not be linear and may have parabolic, hyperbolic or other nonlinear slopes. Further, the central hub 30 can be molded integrally with the center section 18.

Other, variations, modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A game comprising:

a raised inner member having a scalloped exterior wall and a top face surrounding a recess;

a raised outer member concentrically disposed around said inner member and having a top face;

a surface sloped downwardly from said outer member to said inner member, said surface rigidly fixed to both said outer and inner members;

a perimeter wall rigidly fixed to and circumscribing said outer member;

an inner ring removably disposed on said top face of said inner member, said inner ring having indicia disposed thereon corresponding to and defining meanings for each of said scallops of said scalloped exterior wall; and a hub removably engagable with said recess for securing said inner ring to said top face of said inner member.

2. The game of claim 1 wherein said inner member, said outer member, said surface and said perimeter wall are formed as a single piece.

3. The game of claim 1 wherein said inner ring is two-sided having indicia disposed on both sides thereof for altering said meaning of said scallops by reversing said inner ring.

4. The game of claim 1 further comprising additional inner rings removably disposed on said top face of said inner member having indicia disposed thereon altering said meaning of said scallops.

5. The game of claim 1 further comprising a plurality of pockets defined between said perimeter wall and said outer member for containing game pieces.

6. The game of claim 1 further comprising an outer ring removably disposed on said top face of said outer member, said outer ring having indicia disposed thereon.

7. The game of claim 6 wherein said outer ring comprises multiple independent ring sections.

8. The game of claim 7 wherein each of said ring sections include downwardly extending lips for securing said outer ring to said top face of said outer member.

9. The game of claim 1 wherein said outer member defines a plurality of downwardly open wells for receiving legs.

10. The game of claim 1 further comprising a horizontal top removably disposed on said outer member for providing a flat surface.

11. A game comprising:

a raised inner member having a scalloped exterior wall and a top face surrounding a recess;

a raised outer member concentrically disposed around said inner member and having a top face;

a surface sloped downwardly from said outer member to said inner member, said surface rigidly fixed to both said outer and inner members;

a perimeter wall rigidly fixed to and circumscribing said outer member defining a plurality of pockets therewith for containing game pieces, wherein said inner member, said outer member, said surface and said perimeter wall are formed as a single piece;

a two-sided inner ring removably disposed on said top face of said inner member, said inner ring having indicia disposed on both sides thereof, said respective indicia corresponding to and defining meanings for each of said scallops of said scalloped exterior wall;

a hub removably engagable with said recess for securing said inner ring to said top face of said inner member;

an outer ring removably disposed on said top face of said outer member, said outer ring having indicia disposed thereon.

12. The game of claim 11 wherein said outer member defines a plurality of downwardly open wells for receiving legs.

13. The game of claim 11 further comprising a horizontal top removably disposed on said outer member for providing a flat surface.

* * * * *